United States Patent [19]

Youngberg et al.

[11] 4,214,340

[45] Jul. 29, 1980

[54] RETRACTABLE BRUSH WITH ROTATABLE ACTUATING MECHANISM

[75] Inventors: Fred A. Youngberg, Irving; Clarence D. Zierhut, Richardson, both of Tex.

[73] Assignee: John Lewis, Arlington, Tex. ; a part interest

[21] Appl. No.: 10,430

[22] Filed: Feb. 8, 1979

[51] Int. Cl.[2] ..... A46B 9/08

[52] U.S. Cl. ..... 15/184

[58] Field of Search ..... 15/169, 184; 132/119-123, 154, 145

[56] References Cited

U.S. PATENT DOCUMENTS

| | | | |
|---|---|---|---|
| 1,302,247 | 4/1919 | Troy | 132/119 |
| 1,388,955 | 8/1921 | Kozlowsky et al. | 132/119 |
| 1,631,011 | 5/1927 | Connor . | |
| 1,927,093 | 9/1933 | Ingwersen et al. . | |
| 2,159,432 | 5/1939 | Enns . | |
| 2,296,525 | 9/1942 | Johnson | 15/184 |
| 2,660,183 | 11/1953 | Gruring | 15/169 |
| 2,674,001 | 4/1954 | Abrams et al. | 15/184 |
| 2,865,039 | 12/1958 | Kaye et al. | 15/184 |
| 3,055,033 | 9/1962 | Peilet et al. | 15/184 |
| 3,065,757 | 11/1962 | Peilet . | |
| 3,765,049 | 10/1973 | Green et al. | 15/184 |

*Primary Examiner*—Stanley N. Gilreath

*Attorney, Agent, or Firm*—Richards, Harris & Medlock

[57] ABSTRACT

A retractable brush (10) is provided and includes a housing (12). Housing (12) includes sidewalls (18, 30), end walls (20, 22, 32, 34), a top wall (26, 38) and a bottom wall (24, 36). A bristle carrier (60) is provided and includes a plurality of bristles (50) mounted within housing (12) for slidable movement therein. The bristle carrier (60) is movable between a retracted position wherein the bristle carrier (60) and the plurality of bristles (50) are contained within housing (12) and an extended position wherein bristle carrier (60) is contained within housing (12) and the plurality of bristles (50) extend beyond the top wall (26, 38) of housing (12). The bristle carrier (60) includes an elongated slot (48). The first sidewall (18) of housing (12) includes a rotatable structure (42) for engaging the elongated slot (48), such that upon rotation of the rotatable structure (42) the bristle carrier (60) and the plurality of bristles (50) move between the retracted position and the extended position to positively retract and extend the plurality of bristles (50) from the housing (12).

5 Claims, 12 Drawing Figures

RETRACTABLE BRUSH WITH ROTATABLE ACTUATING MECHANISM

TECHNICAL FIELD

This invention relates to retractable brushes, and more particularly relates to a retractable brush having a rotatable actuating mechanism.

BACKGROUND ART

Numerous portable and retractable brushes have been provided in which a bristle member is adjusted to a fully concealed position within a housing. Such brushes are adaptable to be conveniently carried about a person, for example, in a pocket or in a handbag and usable for a variety of purposes. These purposes include grooming, clothes brushes, shoe brushes and the like. A principal benefit of such brushes is their compact construction and ease of operation.

Examples of previously developed retractable brushes include those described in U.S. Pat. No. 2,674,001 issued to Abrams, et al on Apr. 6, 1954 and entitled "Pocket Wearing Apparal Brush"; U.S. Pat. No. 2,865,039 issued to Kaye, et al on Dec. 23, 1958 and entitled "Retractable Brush"; U.S. Pat. No. 2,916,756 issued to Peilet, et al on Dec. 15, 1959 and entitled "Double-Acting Self-Cleaning Retractable Brush"; and U.S. Pat. No. 3,065,757 issued to Peilet on Nov. 27, 1962 and entitled "Retractable Brushes or the Like With Locking Devices". Such prior art retractable brushes are composed of numerous components and require a complex actuating mechanism. Furthermore, prior brush construction has required strict adherence to close manufacturing tolerances. This requirement of close manufacturing tolerances has a direct bearing upon the reliability and life of such retractable brushes. The number of components and complexity of actuation, additionally, has a direct bearing on the wear of the brush components.

A need has thus arisen for a retractable brush that has a minimum number of components and which is simple to actuate to insure a reliable product and one which is maintenance free. A need has further arisen for a retractable brush that is easy to manufacture in that manufacturing tolerances are not critical. A need has further arisen for a retractable brush that is compact and relatively inexpensive to manufacture.

DISCLOSURE OF THE INVENTION

In accordance with the present invention, a retractable brush is provided which substantially eliminates or reduces the problems heretofore present in retractable brushes.

In accordance with the present invention, a retractable brush is provided and includes a housing having first and second sidewalls, end walls, a top wall and a bottom wall. A bristle carrier is provided and includes a plurality of bristles mounted within the housing for slidable movement therein. The bristle carrier is movable between a retracted position wherein the bristle carrier and the plurality of bristles are contained within the housing and an extended position wherein the bristle carrier is contained within the housing and the plurality of bristles extend beyond the top wall of the housing. The bristle carrier includes an elongated slot. The first sidewall of the housing includes rotational structure for engaging the elongated slot, such that upon rotation of the rotational structure, the bristle carrier and the bristles move between the retracted position and the extended position to positively retract and extend the plurality of bristles from the housing.

In accordance with another aspect of the present invention, a retractable brush is provided and includes a housing having first and second sidewalls, end walls, a top wall and a bottom wall. A bristle carrier includes first and second sidewalls. A plurality of bristles are mounted on the bristle carrier. The bristle carrier is positioned within the housing for slidable movement therein, such that the bristle carrier is movable between a retracted position wherein the bristle carrier and the plurality of bristles are contained within the housing and an extended position wherein the bristle carrier is contained within the housing and the plurality of bristles extends beyond the top wall of the housing. The first sidewall of the bristle carrier includes an elongated slot. The first sidewall of the housing includes a dial rotatably mounted in the first sidewall of the housing and disposed opposite the elongated slot of the first sidewall of the bristle carrier. The dial includes a pin and extends inwardly into the housing for engaging the elongated slot in the bristle carrier. Upon rotation of the dial, the bristle carrier and the plurality of bristles move between the retracted position and the extended position to positively retract and extend the plurality of bristles from the housing.

In accordance with yet another aspect of the present invention, a retractable brush is provided and includes a housing having first and second sidewalls, end walls, a top wall and a bottom wall. A bristle carrier including first and second sidewalls is provided. A plurality of bristles are mounted to the bristle carrier. The bristle carrier is disposed within the housing such that the first sidewall of the bristle carrier lies adjacent the first sidewall of the housing and the second sidewall of the bristle carrier lies adjacent the second sidewall of the housing. The bristle carrier is further positioned within the housing for slidable movement therein, such that the bristle carrier is movable between a retracted position wherein the bristle carrier and the plurality of bristles are contained within the housing and an extended position wherein the bristle carrier is contained within the housing and the plurality of bristles extend beyond the top wall of the housing. The first sidewall of the bristle carrier includes an elongated slot. The first sidewall of the housing includes a knob rotatably mounted within the first sidewall of the housing. The knob includes a pin integrally formed with the knob and extends inwardly into the housing for engaging the elongated slot in the first sidewall of the bristle carrier, such that upon rotation of the knob, the bristle carrier and the plurality of bristles move between the retracted position and the extended position to retract and extend the plurality of bristles from the housing. The second sidewall of the housing facing the second sidewall of the bristle carrier includes a rib. The second sidewall of the bristle carrier includes a groove positioned for engaging the rib of the second sidewall of the housing for guiding the bristle carrier between the retracted and extended positions within the housing.

BRIEF DESCRIPTION OF DRAWINGS

For a more complete understanding of the present invention and for further objects and advantages thereof, reference is now made to the following Detailed Description taken in conjunction with the accompanying Drawings in which.

DETAILED DESCRIPTION

Figure 1:
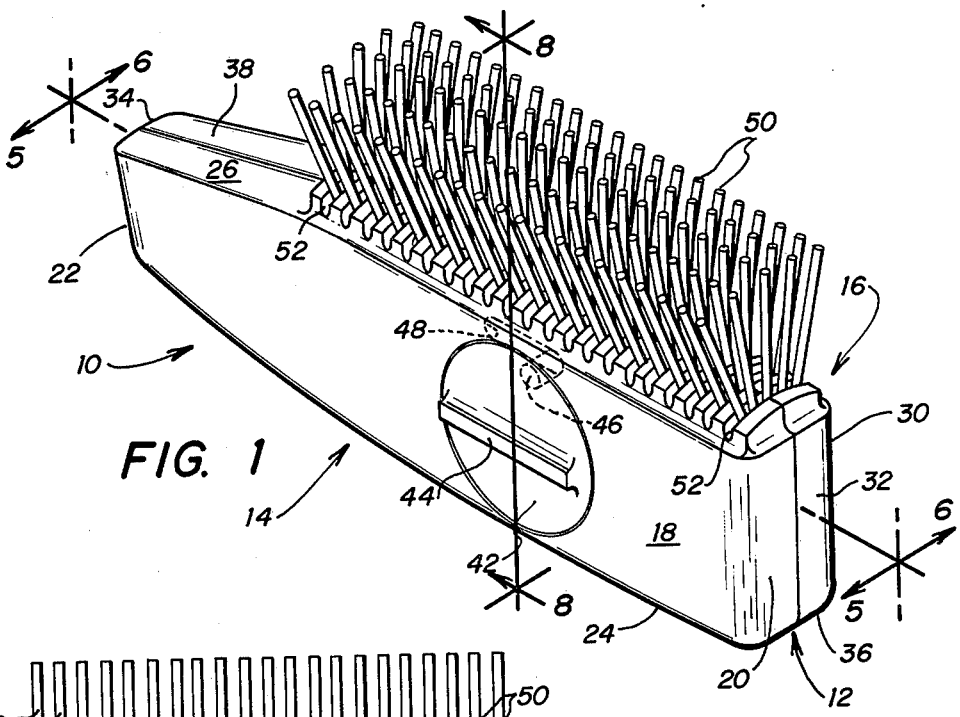
FIG. 1 is a perspective view of the retractable brush of the present invention shown in the extended position.
Figure 9:
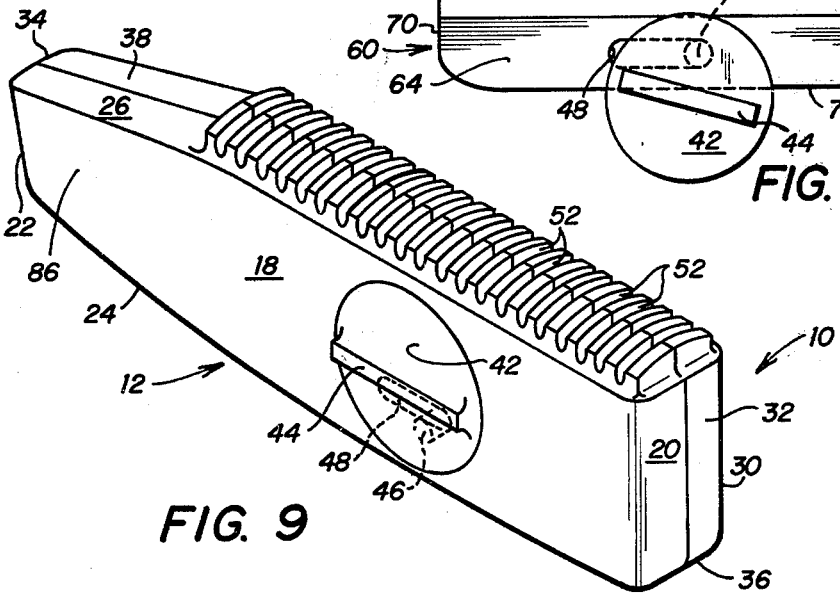
FIG. 9 is a perspective view of the retractable brush of the present invention shown in the retracted position.

Referring to FIGS. 1 and 9, a perspective view of the retractable brush of the present invention in the extended position (FIG. 1) and retracted position (FIG. 9) is illustrated and is generally identified by the numeral 10. Retractable brush 10 includes a housing generally identified by the numeral 12. Housing 12 is composed of two half sections, generally identified by the numerals 14 and 16. Housing half 14 includes a sidewall 18, end walls 20 and 22, a bottom wall 24 and a top wall 26. Similarly, housing half 16 includes a sidewall 30, end walls 32 and 34, a bottom wall 36 and a top wall 38.

Disposed within sidewall 18 of housing 12, is a dial 42 having a raised central portion 44 to permit an operator to grasp and rotate dial 42. Disposed on the interior surface of dial 42 and extending inwardly into housing 12 is a pin 46. Pin 46 may be integrally formed with dial 42 or mechanically fastened thereto. Pin 46 engages an elongated actuating slot 48 contained within a bristle carrier to be subsequently described. A plurality of bristles 50 are interconnected to the bristle carrier and extend through apertures 52 disposed within top walls 26 and 38 of housing 12.

Figure 2:
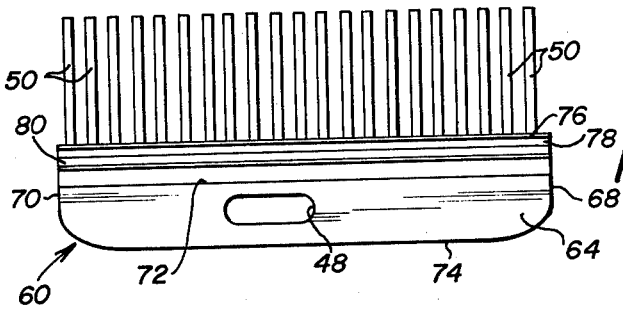
FIG. 2 is a side elevational view of the bristle carrier and bristles of the present invention showing the actuating groove.
Figure 4:
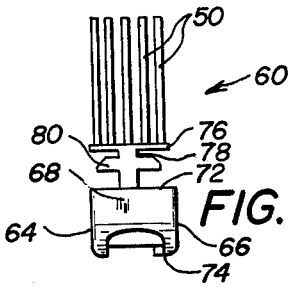
FIG. 4 is an end view of the bristle carrier and bristles of the present invention.
Figure 3:
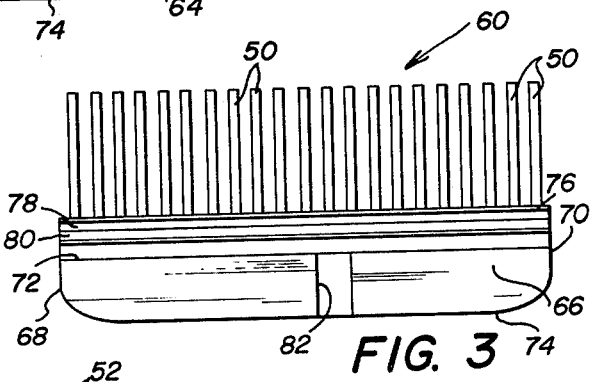
FIG. 3 is a side elevational view of the bristle carrier and bristles of the present invention showing the guide groove.

Referring simultaneously to FIGS. 2–4, the bristle carrier of the present invention is illustrated and is generally identified by the numeral 60. Bristle carrier 60 is disposed within housing 12 of retractable brush 10 for slidable movement therein between the retracted position as illustrated in FIG. 9 wherein bristle carrier 60 and bristles 50 are contained within housing 12 and the extended position as illustrated in FIG. 1, wherein bristle carrier 60 is contained within housing 12 and the plurality of bristles 50 extend beyond top walls 26 and 38 of housing 12. Bristle carrier 60 includes sidewalls 64 and 66, end walls 68 and 70 and top and bottom walls 72 and 74. Sidewall 64 of bristle carrier 60 includes elongated actuating slot 48.

Bristles 50 are interconnected to a bristle mounting plate 76 (FIG. 4) which may be integrally formed with bristles 50 or, alternatively, bristles 50 may be mechanically attached to bristle mounting plate 76. Bristle mounting plate 76 is flexible to cause bristles 50 to spread radially when retractable brush 10 is in the extended position as shown in FIG. 1. This operation will subsequently be described with respect to FIG. 8. Bristle mounting plate 76 is interconnected to bristle carrier 60 using a mounting bar 78 which extends the entire length of bristle carrier 60. Bristle mounting bar 78 may be integrally formed with bristle carrier 60 or, alternatively, may be mechanically affixed to bristle carrier 60. Also attached to bristle mounting bar 78 is a plate 80 disposed below and parallel to bristle mounting plate 76 along the entire length of bristle carrier 60. The operation of plate 80 will be subsequently described in connection with FIG. 8.

Referring to FIG. 3, sidewall 66 of bristle carrier 60 includes a vertically disposed guide groove 82 extending between top wall 72 and bottom wall 74 of bristle carrier 60. The operation of guide groove 82 will be subsequently described.

Figure 5:
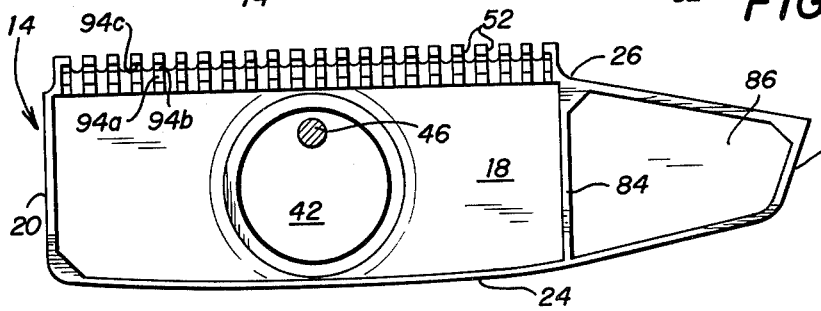
FIG. 5 is a sectional view taken generally along sectional lines 5—5 of FIG. 1 illustrating the housing of the retractable brush of the present invention.

FIG. 5 illustrates the interior portion of housing half 14 of housing 12 of retractable brush 10. It can be seen that pin 46 projects inwardly into the interior of housing 12 from dial 42. Housing half 14 further includes a reinforcing wall 84 which defines a handle member 86 of retractable brush 10. Dial 42 is free to rotate in a 360° circle within sidewall 18 of housing 12 when housing half 14 is disassembled from bristle carrier 60. As will subsequently be described in connection with FIG. 7, pin 46 engages actuating slot 48 of bristle carrier 60 and is movable longitudinally within slot 48 to effect movement and locking of bristle carrier 60 within housing 12.

Figure 6:
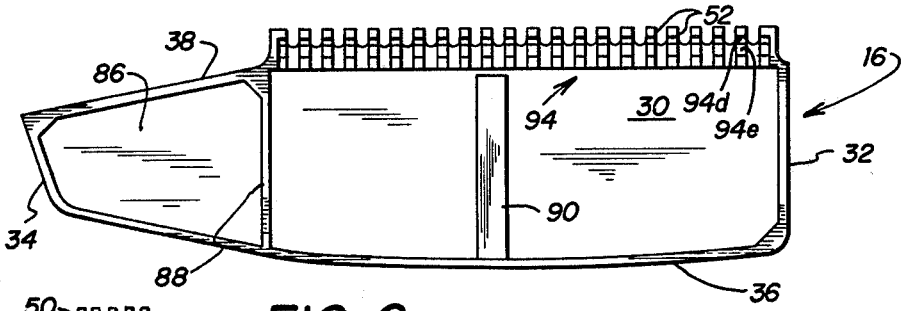
FIG. 6 is a sectional view taken generally along sectional lines 6—6 of FIG. 1 illustrating the housing of the retractable brush of the present invention.

Referring to FIG. 6, the interior portion of housing half 16 of housing 12 of retractable brush 10 as illustrated. Housing half 16 includes a reinforcing wall 88 corresponding in position to reinforcing wall 84 (FIG. 5) of housing half 14 to define handle member 86. Centrally disposed within the interior of housing half 16 is a vertically disposed rib 90 which is positioned to engage guide groove 82 of sidewall 66 (FIG. 3) of bristle carrier 60. The engagement of rib 90 with guide groove 82 maintains bristle carrier 60 in an aligned position within housing 12 when bristle carrier 60 moves between the extended and retracted positions (FIGS. 1 and 9). Rib 90 and guide groove 82 permit smooth actuation of retractable brush 10 to permit bristles 50 to move within apertures 52.

Referring to FIG. 7, the operation of the present retractable brush 10 will now be described. An important aspect of the present retractable brush 10 is the rotatable actuating mechanism comprised of dial 42, pin 46 and actuating slot 48 of bristle carrier 60. Rotation of dial 42 effectuates the motion of bristle carrier 60 and bristles 50 between the retracted position as shown in FIG. 9 and the extended position as shown in FIG. 1 and further locks bristle carrier 60 in the extended position.

Figure 7A:
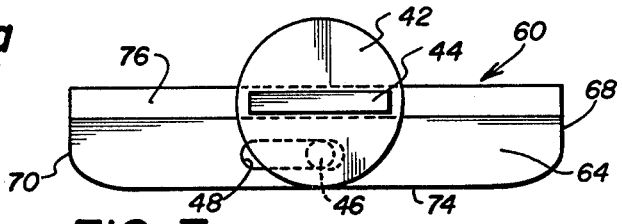
FIGS. 7*a*, 7*b* and 7*c* are diagrammatic illustrations showing the operation of the retractable brush of the present invention.
Figure 7B:
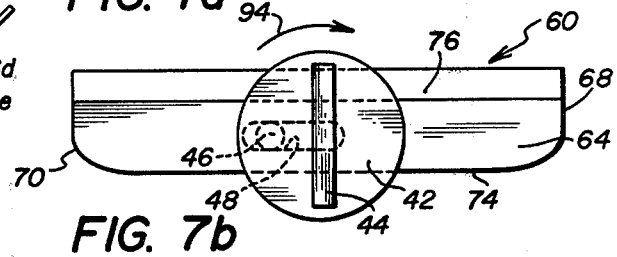

FIG. 7*a* illustrates the relative position of dial 42 and pin 46 within actuating slot 48 corresponding to the retracted position of retractable brush 10 shown in FIG. 9. Bottom wall 74 of bristle carrier 60 is positioned adjacent bottom walls 24 and 36 of housing halves 14 and 16 of housing 12. Pin 46 engages actuating slot 48 near the end of actuating slot 48 adjacent end wall 68 of bristle carrier 60. In the retracted position, raised central portion 44 of dial 42 is horizontally disposed. To effectuate extension of bristles 50 from housing 12 of retractable brush 10, an operator grasps raised central portion 44 of dial 42 to rotate dial 42 in the clockwise direction as indicated by arrow 94 (FIG. 7*b*). Such rotation causes pin 46 to move within actuating slot 48 towards end wall 70 of bristle carrier 60. FIG. 7*b* illustrates the position of bristle carrier 60 approximately one-half extended and one-half retracted.

Figure 7C:
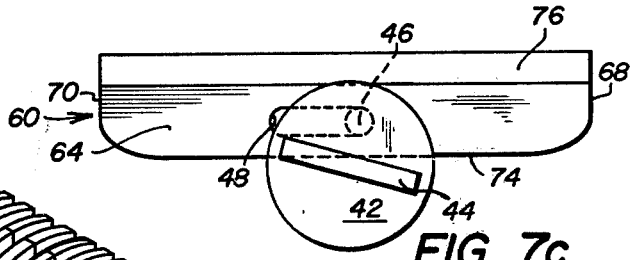

Upon further rotation of dial 42 in the direction of arrow 94, the fully extended position of bristle carrier 60 is reached and is illustrated in FIG. 7*c*. It is now seen that raised central portion 44 is slightly off center from the horizontal position of FIG. 7*a* and pin 46 is disposed within actuating slot 48 at the end of actuating slot 48 adjacent end wall 68 of bristle carrier 60. The position of pin 46 in actuating slot 48 when bristle carrier 60 has reached the fully extended position as shown in FIG. 7*c* locks retractable brush 10 in the fully extended position. The present actuating mechanism of retractable brush 10 is therefore seen to be relatively simple, involving a minimum number of components without the need for close manufacturing tolerances. To effectuate the retraction of bristle carrier 60 and bristles 50 within housing 12, the operator merely reverses rotation of dial 42 in the opposite sequence of FIGS. 7*a*, 7*b* and 7*c*, previously described.

Referring to FIG. 8, the operation of bristle carrier 60 will now be described. An important aspect of the present retractable brush 10 is the action of bristle mounting plate 76 within housing 12 to cause bristles 50 to spread and extend radially outwardly of sidewalls 18 and 30 of housing 12 to thereby provide a larger bristle surface area than defined by top walls 26 and 38 of housing 12.

Figure 8A:
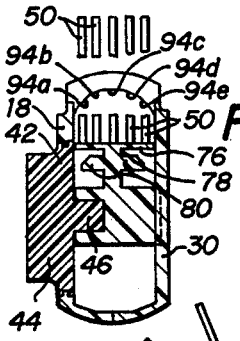
FIGS. 8*a* and 8*b* are sectional views taken generally along sectional lines 8—8 of FIG. 1 illustrating the operation of the retractable brush of the present invention.
Figure 8B:
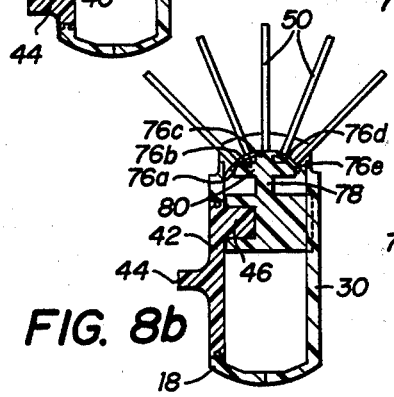

FIG. 8*a* illustrates the position of bristles 50 and bristle mounting plate 76 within housing 12. It can be seen that bristle carrier 60 and bristles 50 are substantially in the position as shown in FIG. 4. As bristle carrier 60 moves upwardly within housing 12, bristles 50 extend through aperatures 52 to emerge from housing 12. As bristle carrier 60 completes its path of motion, bristle mounting plate 76 engages interior surface 94 of top walls 26 and 38 of housing 12. This engagement causes bristle mounting plate 76 to curve to conform to interior surface 94 to thereby cause bristles 50 to spread radially as shown in FIG. 8*b*. FIG. 8*b* illustrates bristle mounting plate 76 composed of segments 76*a*–76*e* which conform to interior surfaces 94*a*–94*e* of housing 12 top walls 26 and 38. Bristle mounting plate segments 76*a* and 76*e* abut against plate 80 to lock bristles 50 in the spread position as shown in FIG. 8*b* during use of retractable brush 10.

Retractable brush 10 may be fabricated from numerous plastic materials. For example, housing 12 may be formed from high impact styrene material, dial 42 may be formed from Noryl material and bristles 50 may be formed from polypropylene material.

It therefore can be seen that the present retractable brush is easy to operate and insures reliability and endurance. The retractable brush of the present invention further is easy to manufacture in that there are few components and manufacturing tolerances are not critical. The retractable brush of the present invention is further lightweight and compact for easy carrying.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A retractable brush comprising:

a housing having first and second sidewalls, end walls, a convex top wall and a bottom wall;

said convex top wall of said housing including a plurality of elongated apertures extending between said first and second sidewalls of said housing;

bristle carrying means having first and second sidewalls and a flexible top wall;

a plurality of bristles mounted to said flexible top wall of said bristle carrying means and being disposed substantially perpendicular to said flexible top wall of said bristle carrying means;

said bristle carrying means being disposed within said housing, such that said first sidewall of said bristle carrying means lies adjacent said first sidewall of said housing and said second sidewall of said bristle carrying means lies adjacent said second sidewall of said housing and further being positioned within said housing for slidable movement therein, such that said bristle carrying means is movable between a retracted position wherein said bristle carrying means and said plurality of bristles are contained within said housing and an extended position wherein said bristle carrying means is contained within said housing and said plurality of said bristles extend through said plurality of elongated apertures beyond said convex top wall of said housing in a radially spread position to thereby widen the brushing area of the retractable brush;

said plurality of bristles being maintained in said substantially perpendicular position to said flexible top wall of said bristle carrying means in said retracted position;

said flexible top wall of said bristle carrying means in said extended position of said bristle carrying means engaging said convex top wall of said housing, such that said flexible top wall of said bristle carrying means conforms to the interior surface of said convex top wall of said housing to thereby force said plurality of bristles to radially spread within said plurality of elongated apertures to extend ones of said plurality of bristles beyond said first and second sidewalls of said housing in said extended position of said bristle carrying means;

said first sidewall of said bristle carrying means including an elongated slot;

said first sidewall of said housing including knob means rotatably mounted within said first sidewall of said housing;

said knob means including pin means extending inwardly into said housing for engaging said elongated slot in said first sidewall of said bristle carrying means, such that upon rotation of said knob means, said bristle carrying means and said plurality of bristles move between said retracted position and said extended position to retract and extend said plurality of bristles from said housing;

said second sidewall of said housing disposed adjacent said second sidewall of said bristle carrying means including rib means; and said second sidewall of said bristle carrying means including a groove positioned for engaging said rib means of said second sidewall of said housing for guiding said bristle carrying means between said retracted position and said extended position.

2. The retractable brush of claim 1 wherein said housing further includes handle means extending from one of said end walls of said housing.

3. The retractable brush of claim 1 wherein said knob means rotates approximately 180° between said bristle carrying means extended and retracted positions.

4. The retractable brush of claim 1 and further including:

means for locking said bristle carrying means in said extended position.

5. The retractable brush of claim 1 wherein said knob means and said pin means are integrally formed.

* * * * *